United States Patent [19]

Davis

[11] Patent Number: 4,567,992

[45] Date of Patent: Feb. 4, 1986

[54] CHILD RESISTANT AND TAMPER-RESISTANT CONTAINER AND CLOSURE ASSEMBLY

[75] Inventor: Eugene E. Davis, Ilford, England

[73] Assignee: Johnsen & Jorgensen (Plastics) Limited, England

[21] Appl. No.: 676,293

[22] Filed: Nov. 29, 1984

[30] Foreign Application Priority Data

Dec. 1, 1983 [GB] United Kingdom ..... 8332149
Feb. 2, 1984 [GB] United Kingdom ..... 8402725

[51] Int. Cl.[4] ..... B66C 23/92

[52] U.S. Cl. ..... 215/222; 215/223; 215/256

[58] Field of Search ..... 206/528, 807; 215/222, 215/256, 250, 253, 252, 254, 223; 220/265, 266, 270

[56] References Cited

U.S. PATENT DOCUMENTS

| | | | |
|---|---|---|---|
| 958,221 | 5/1910 | Bolton | 215/332 |
| 3,344,942 | 10/1967 | Hedgewick | 215/222 |
| 3,510,021 | 5/1970 | Silver | 215/256 |
| 3,608,765 | 9/1971 | Faulstich | 215/256 |
| 3,672,528 | 6/1972 | Faulstich | 215/256 |
| 3,704,804 | 12/1972 | Kaercher et al. | 220/270 |
| 3,917,096 | 11/1975 | Hedgewick | 215/222 |
| 3,946,891 | 3/1976 | Picoy et al. | 215/256 |
| 4,029,231 | 6/1977 | Jonsson | 220/270 |
| 4,032,029 | 6/1977 | Cochrane | 220/270 |
| 4,037,746 | 6/1977 | VerHage | 215/256 |
| 4,091,948 | 5/1978 | Northup | 215/222 |
| 4,129,226 | 12/1978 | Percival | 215/253 |
| 4,166,552 | 9/1979 | Faulstich | 215/256 |
| 4,303,167 | 12/1981 | Martinel | 215/256 |
| 4,305,516 | 12/1981 | Perne et al. | 215/252 |
| 4,474,302 | 10/1984 | Goldberg et al. | 215/256 |
| 4,485,932 | 12/1984 | Kusz | 215/222 |

*Primary Examiner*—Joseph Man-Fu Moy
*Assistant Examiner*—David Fidei
*Attorney, Agent, or Firm*—Roylance, Abrams, Berdo & Goodman

[57] ABSTRACT

This invention provides a tubular container body and closure assembly with a smooth or flush outside surface. The assembly is provided with bayonet type child resistant closure and tear away tamper resistant band. The container body has a recess to receive a teartab on the tear away band so that the flush outside surface is maintained, the recess in the body being so positioned that when the tear tab is aligned with the recess an internal bead on the closure forming part of the bayonet type locking arrangement is aligned with an external locking slot on the body so that the closure can be applied to the body by a longitudinal downward movement.

15 Claims, 6 Drawing Figures

CHILD RESISTANT AND TAMPER-RESISTANT CONTAINER AND CLOSURE ASSEMBLY

FIELD OF THE INVENTION

This invention is concerned with the provision of a child-resistant and tamper-resistant container body and closure assembly.

BACKGROUND OF THE INVENTION

At present articles such as pain relieving tablets are often packed in cylindrical or tubular packs which comprise a tubular body and a closure seating flush on the body and which is secured in position on the body by a bayonet type connection so that the closure is applied to the body by a combined downward and sideways oblique movement by turning the closure clockwise until beads on the inside of the closure each enter a locking slot on the exterior of the body. In order to remove the closure from the body it is necessary to press the closure down relatively to the body so that the beads are each moved out of their slot and then to turn the closure in a counter clockwise direction. Preferably some kind of spring means e.g. a spring washer or plate inside the closure is provided in existing packs so that the downward movement of the closure relative to the body on removal of the closure takes place against the action of the spring which in turn urges the beads into the locking slots and holds them there. Packs of the above kind give effective child resistance because an attempt to turn the closure without applying the downward pressure fails. On the other hand packs of the above kind do not incorporate a tamper-resistant feature.

To incorporate a tamper-resistant feature and at the same time to retain the flush cylindrical exterior appearance of the pack introduces difficult problems. For one thing a tear away tamper-resistant band usually requires the provision of a projecting tear tab which would destroy the flush exterior of the pack unless special steps be taken, and would make it difficult for the pack to be used in a vending system in which a new pack rolls into position as soon as a previous pack has been sold. Another problem was that in the existing type of pack the combined angular and downward oblique movement of the closure relatively to the body was insufficient to move a tear band into operative position. The provision of spring means as a third separate item was also an unwelcome assembly problem.

SUMMARY OF THE INVENTION

It is the main object of the present invention to provide a container body and closure assembly with a flush exterior and with both a child-resistant and a temper-resistant capability.

According to the present invention there is provided a tubular container body and closure with a flush outside surface and a bayonet type connection wherein the closure, which includes a tamper resistant tear away band, can be initially applied to seal the container body by direct down movement substantially parallel to the longitudinal axis of the body, the body being provided with at least one external recess to receive a tear tab or tongue attached to the tear away band, and wherein the recess or recesses is/are so positioned that when the tear tab or tongue enters a recess, beads on the inside of the closure are correctly positioned to enter the locking slots of a bayonet type fitting on the outside of the body, spring means being provided to hold the closure in its closed position. It will be understood therefore that in this invention the closure is initially applied to the container by direct straight downward movement rather than by a combined simultaneous oblique downward and angular movement. In this invention the positive substantially axial downward movement is sufficient to move the tamper-resistant tear away band into its operative position with an external annular projection on the body. Beads and projections on the closure and on the body are specially shaped so that the downward movement of closure is facilitated. Suitable spring means is provided to hold the bayonet type connection in its operative position and to provide a child-resistant feature.

BRIEF DESCRIPTION OF THE DRAWINGS

In order that the invention may be more clearly understood reference is now directed, by way of example, to the accompanying drawings in which.

DETAILED DESCRIPTION OF PREFERRED EMBODIMENTS

Figure 1:
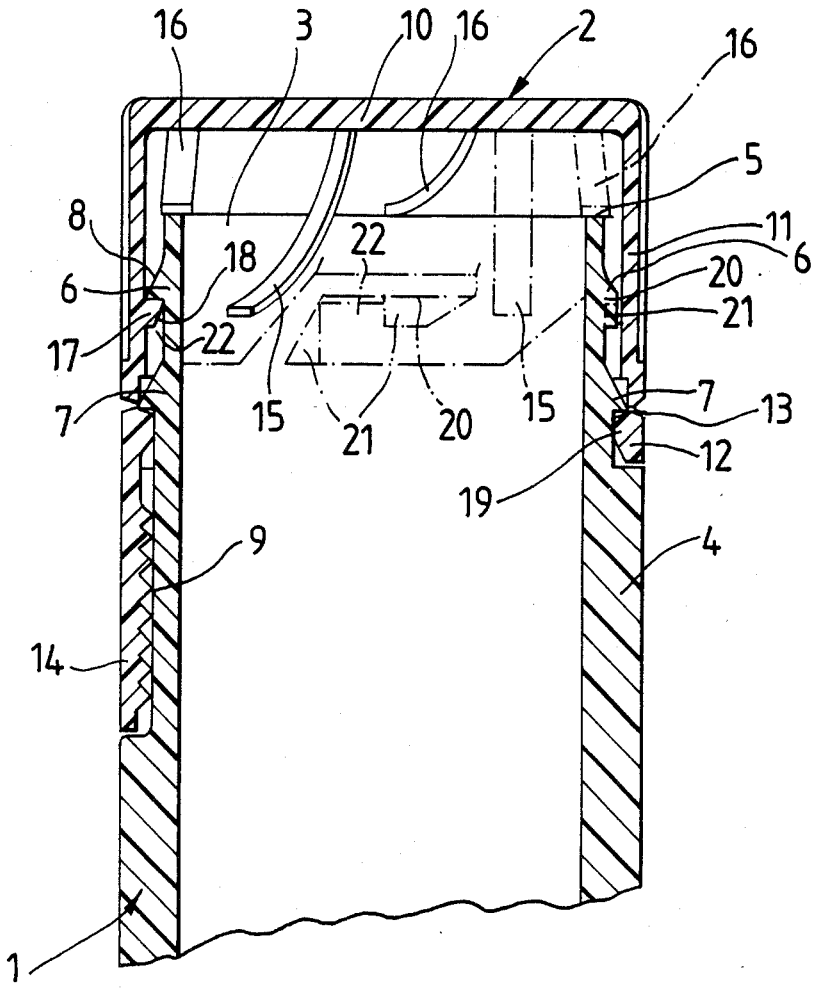
FIG. 1 is a longitudinal sectional view of a preferred form of container body and closure assembly, according to the invention, the lower part of the body being broken away.

Referring to the drawings the assembly comprises a body 1 and a closure 2. The body 1 has an open mouth 3 and a side wall 4, the mouth 3 being defined by an upper edge 5. The body 1 also has upper projections 6 and a lower annular projection 7. The upper projections 6 which form part of the bayonet type connection are shaped with an inclined upper face 8 with a lower edge 20 meeting vertical faces 21 framing locking slot 22 (which accommodate beads 17 when tube is sealed) to facilitate downward movement of the closure 2 into its initial operative position and the wall 4 of the body 1 has a recess 9.

The closure 2 has a top 10, a depending skirt 11 which is ribbed as shown and tear away tamper-resistant band 12 connected to the skirt 11 by a line 13 of weakness. A tear tab or tongue 14 is provided to facilitate removal of the band 12 and the tab or tongue 14 is accommodated within the recess 9 to maintain the flush exterior surface of the assembly. The tear tab 14 is ribbed in a similar fashion to the skirt 11 to facilitate gripping and to aid in moulding the parts of the assembly.

Figure 5:
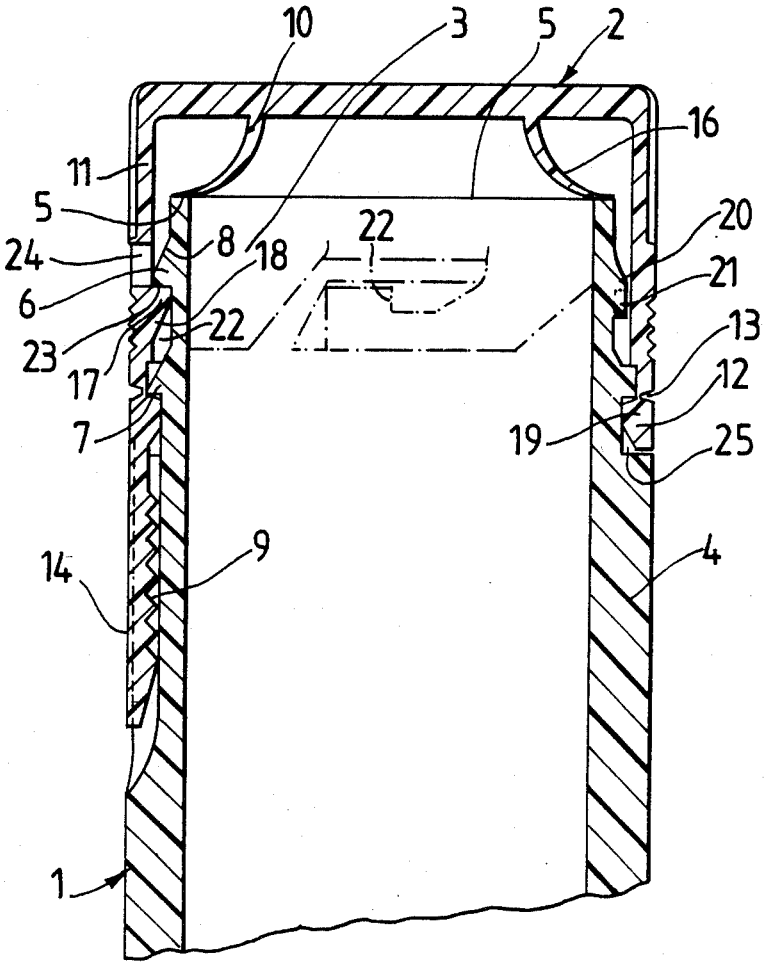
FIG. 5 is a sectional view of a part of a modified assembly.

The closure 2 is also provided with a spring member 16 to rest upon and press against the edge 5 of the top of the body 1 to hold the bayonet type fitting in its connected position and, in the embodiment shown in FIG. 5 to act as a seal to protect the contents of the body 1.

The closure 2 also has a number of internal beads 17 shaped on the underside as shown with an inclined surface 18 to facilitate downward movement of the beads 17 past the projections 6 into locking slot 22. In that movement the surface 18 slides down the surface 8 with expansion of the skirt 11 until the beads 17 have passed the projections 6 into slot 22, whereupon the skirt which has a resilient capability returns to the position shown in FIG. 1. It will be understood that the number of beads 17 corresponds to the number of bayonet type slots provided on the outside surface of the body 1. In addition to the above the tear band 12 has an internal annular ridge 19 for co-operation with the annular projection 7 on the body 1.

In the drawings only one recess 9 is shown but if desired more than one recess 9 may be provided so long as each recess 9 is correctly positioned so that when the tab 14 enters the recess 9 the beads 17 are immediately above a slot 22 in the bayonet type fitting.

In operation the body 1 is filled and the closure 2 is then placed in position above the body 1 with the tear tab 14 immediately above the recess 9 in the body. The closure 2 is then pushed straight down on to the body so that the beads 18 pass the projections 6 into slots 22 in the position shown in FIG. 1, the ridge 19 on the band 12 passes simultaneously below the projection 7 on the body into the position shown in FIG. 1, the spring member 16 presses upon the edge 5 around the mouth 3 of the body 1. As soon as downward pressure on the closure is released the spring member 16 exerts upward pressure on the closure which is thereby moved slightly upwards so that the beads 17 on the closure each enter a slot 22 on the body forming part of the bayonet type connection. The assembly is now in a tamper-resistant and child-resistant condition. To remove the closure 2 it is first necessary to grip the tab 14 and to tear away the band 12. Once the band 12 has torn away it has fulfilled its function because the absence of a band 12 gives evidence that the closure may have been removed and the contents of the body may have been tampered with. However, the child-resistant capability remains and to remove the closure 2 it is necessary to press down on the closure against the spring member 16 to release the beads 17 from the locking slots 22, then to turn the closure counter-clockwise until the closure can be pulled off the body. An attempt to turn the closure 2 without first disengaging the beads 17 from their locking slots 22 will fail.

It will be understood that we have provided a tubular pack that can, if desired, be of substantially the same size and shape as existing packs with a smooth outside surface so that the pack can roll in a dispensing or vending unit. The pack is tamper-resistant and child-resistant and the closure can be "banged on" vertically downwards on to the body, the closure being correctly positioned relatively to the body by insertion of the tear tab or tongue into the or one of the recesses 9.

The body 1 and closure 2 are preferably moulded from suitable plastics material.

Although, as an example, we have referred to the use of the pack or container to hold pain relieving tablets it will be understood that packs or containers in accordance with the invention may be used to hold many different products including pharmaceutical pills, tablets and the like, and other products where child resistance coupled with tamper resistance are deemed necessary or desirable.

It will be understood that, once the tear band has been removed by the purchaser or authorised user (who will know the pack had not been previously tampered with), the closure will then be used in the normal way as described on above, in Background of the Invention.

Figure 6:
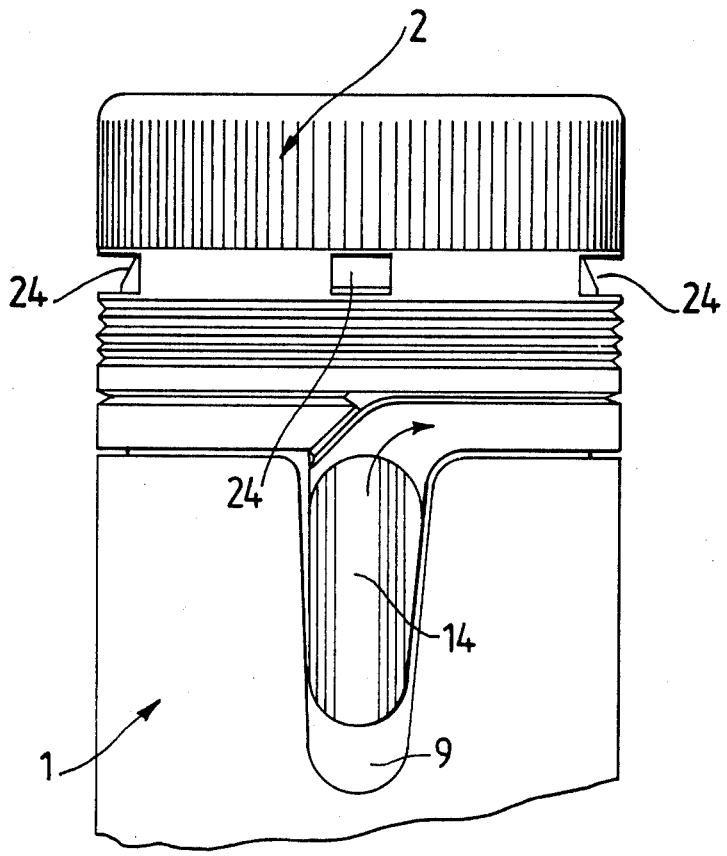
FIG. 6 is a side view.

The container body and closure assembly is preferably moulded from a suitable plastics material and the moulding operation involves the use of a somewhat complicated mould. In this connection it will be noted that the top of each of the beads 17 in the preferred embodiment in FIGS. 5 and 6 is a substantially straight substantially horizontal edge 23 and experiments have shown that the most difficult part of the assembly to mould without having to provide an excessively complicated and therefore rather delicate moulding apparatus is this edge 23. In order to facilitate moulding of the edges 23 we provide openings 24 in the skirt 11 of the cap 2 as shown in FIGS. 5 and 6 so that a moulding member can be inserted sideways through each opening 24 towards the mould core to shape the edges 23. There will be an opening 24 to correspond to each bayonet fitting so the minimum number of openings will be two and above that any convenient and practical number can be provided. The openings 24 will remain in the finished product and so a seal for the mouth 3 of the body 1 is required and that seal is very conveniently provided by the annular spring member 16 the rim 26 of which presses against the edge or rim 5 around the mouth 3.

It will be understood from the above description that the number of beads 17 on the inner surface of the closure 2 will correspond with the number of projections 6 and slots 22 on the outer surface of the body 1 and also with the number of openings 24 in the skirt of the closure.

Figure 2:
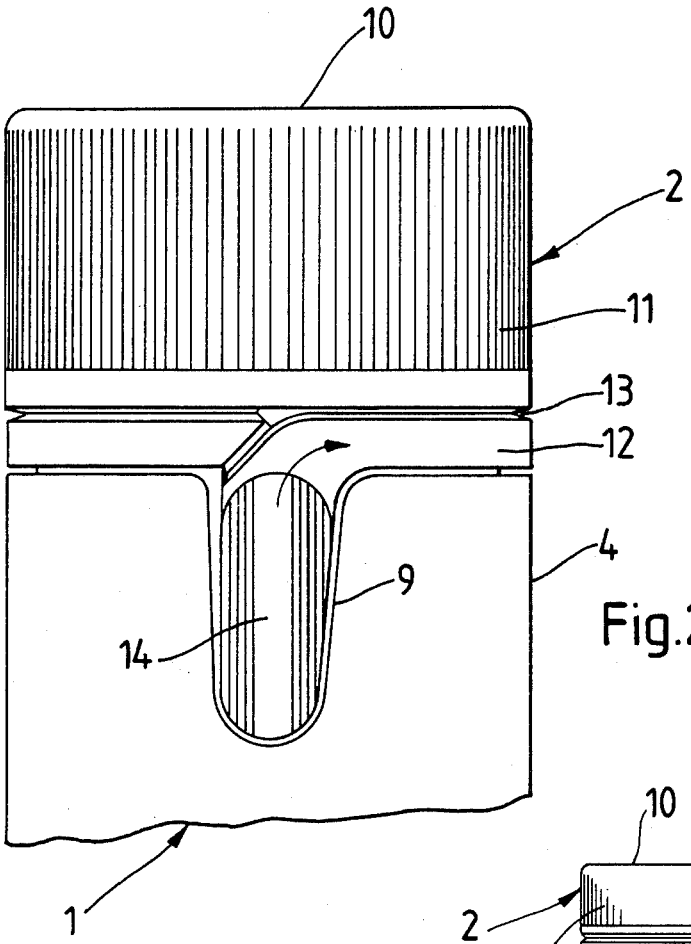
FIG. 2 is a side elevation with the assembly turned through 90°.
Figure 3:
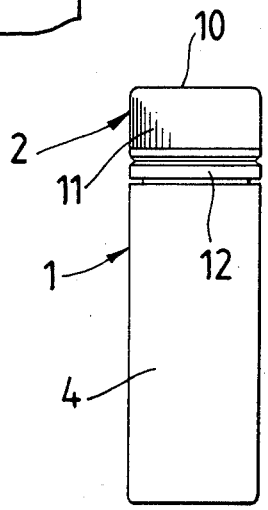
FIG. 3 is a pictorial view showing one assembly in its actual size and is FIG. 2 turned through 180° on a reduced scale.
Figure 4:
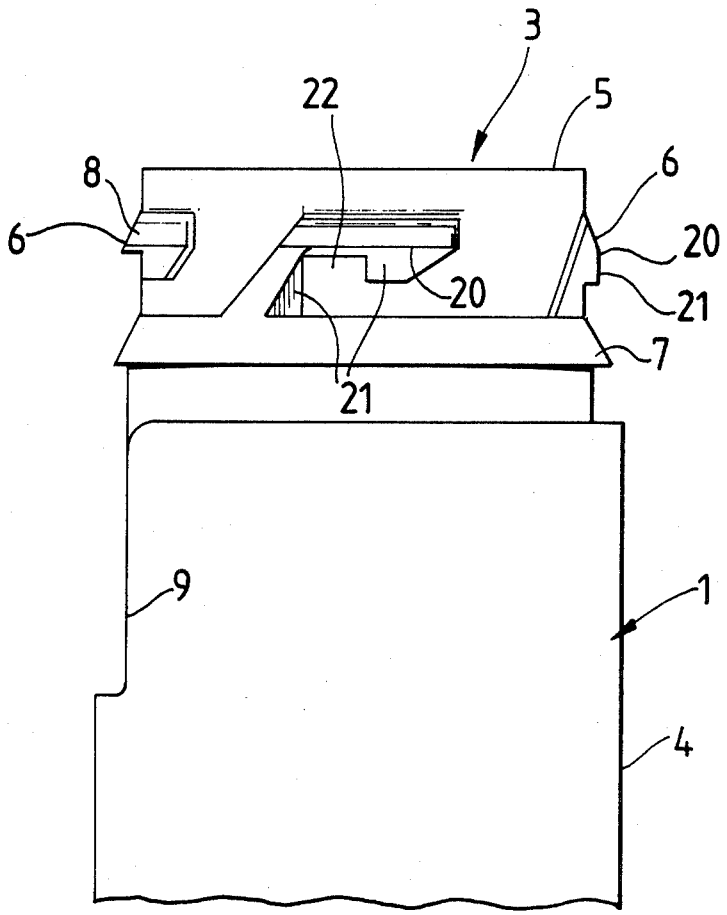
FIG. 4 is a side view of the upper part of the container.

It should be explained that in the embodiment of the invention illustrated there are four sets of beads 17, projections 6, slots 22 and openings 24 see eg FIG. 2 which shows that the sets are radially separated by about 90° from one another. However in FIG. 5 the section line on which the Section is taken is not straight in order that the section line on the left hand side of the figure can pass through an opening 24 and on the right half of the figure can pass between openings 24.

Reference to FIG. 6 will show that when forming the holes or openings 24 a tool can enter and leave the openings at the 180° and 360° positions in a straight in and out movement but to form the openings at the 90° and 270° positions, ie the openings at the right and left in FIG. 6, the tool will enter and leave tangentially to the surface of the closure forming an entry and exit groove in the surface of the closure at each side as well as the opening 24.

If desired the closure 2 may be provided with spring fingers 15 to rest upon the top of the contents of a filled body eg tablets to minimise movement of the contents.

I claim:

1. A tubular child-resistant and tamper-resistant container, comprising:

a container body having an open mouth, a longitudinal axis and a side wall with inner and outer surfaces;

bayonet locking slots on said outer surface adjacent said mouth;

an external recess in said side wall on said outer surface extending downwardly from said mouth and substantially parallel to said longitudinal axis;

a closure having inside and outside surfaces, bayonet locking beads mating with and forming a bayonet connection with said locking slots on said body and a tear band integrally formed as part of said closure, said tear band having a depending tab shaped to conform to and be received in said recess and located relative to said locking beads such that said locking beads are aligned with and engaged in said locking slots when said tab is aligned with and located in said recess, said locking slots and locking beads being formed such that said closure assembly can be applied to said body to close said mouth by a direct downward movement parallel to said longitudinal axis, said outer surface of said body and outside surface of said closure including said tear band having substantially identical configurations such that the container has a flush exterior surface; and spring means, between said body and said closure, for holding said closure in a closed position.

2. A container according to claim 1 wherein said locking slots are defined by upper spaced projections, said body having a lower annular projection engaging said tear band, said upper projections having inclined upper faces for permitting said locking beads to pass over said lower projections during the direct downward movement of said closure.

3. A container according to claim 2 wherein said locking beads have inclined lower surfaces extending downwardly and radially outwardly.

4. A container according to claim 1 wherein each of said locking slots comprises a substantially straight, horizontal edge at a top thereof; and said closure comprises a depending skirt with an opening for each of said locking slots.

5. A container according to claim 1 wherein said body comprises an annular slot on said outer surface receiving said tear band.

6. A tubular child-resistant and tamper-resistant container, comprising:

a tubular body having an open mouth, a longitudinal axis and a side wall with inner and outer surfaces;

a bayonet locking slot on said outer surface adjacent said mouth;

an external recess in said side wall on said outer surface extending downwardly from said mouth and substantially parallel to said longitudinal axis; and a closure having inside and outside surfaces, bayonet locking means for mating with and forming a bayonet connection with said locking slot on said body and a tear band integrally formed as part of said closure, said tear band having a depending tab shaped to conform to and be received in said recess and located relative to said locking means such that said locking means is aligned with and engaged in said locking slot when said tab is aligned with and located in said recess, said locking slot and locking means being formed such that said closure assembly can be applied to said body to close said mouth by a direct downward movement parallel to said longitudinal axis.

7. A container according to claim 6 wherein spring means is provided between a top edge of said body and said closure for holding said closure in a closed position and for forming a seal to protect contents of said body.

8. A container according to claim 6 wherein said locking slot is defined by an upper projection, said body having a lower annular projection engaging said tear band, said upper projection having an inclined upper face for permitting said locking means to pass over said lower projection during the direct downward movement of said closure.

9. A container according to claim 8 wherein said locking means has an inclined lower surface extending downwardly and radially outwardly.

10. A container according to claim 6 wherein said locking slot comprises a substantially straight, horizontal edge at a top thereof; and said closure comprises a depending skirt with an opening for said locking slot.

11. A tubular child-resistant and tamper-resistant container, comprising:

a tubular body having an open mouth, a longitudinal axis and a side wall with inner and outer surfaces;

a bayonet locking slot on said outer surface adjacent said mouth;

an external recess in said side wall on said outer surface; and a closure having inside and outside surfaces, bayonet locking means mating with and forming a bayonet connection with said locking slot on said body and a tear band, said tear band having a depending tab shaped to conform to and be received in said recess and located relative to said locking means such that said locking means is aligned with and engaged in said locking slot when said tab is aligned with and located in said recess, said locking slots and locking means being formed such that said closure can be applied to said body to close said mouth by a direct downward movement parallel to said longitudinal axis, said outer surface of said body and outside surface of said closure including said tear band having substantially identical configurations such that the container has a flush exterior surface.

12. A container according to claim 11 wherein spring means is provided between a top edge of said body and said closure for holding said closure in a closed position and for forming a seal to protect contents of said body.

13. A container according to claim 11 wherein said locking slot is defined by an upper projection, said body having a lower annular projection engaging said tear band, said upper projection having an inclined upper face for permitting said locking beads to pass over said lower projection during the direct downward movement of said closure.

14. A container according to claim 13 wherein said locking means has an inclined lower surface extending downwardly and radially outwardly.

15. A container according to claim 11 wherein said locking slot comprises a substantially straight, horizontal edge at a top thereof; and said closure comprises a depending skirt with an opening for said locking slots.

* * * * *